US005110007A

United States Patent [19]

Law et al.

[11] Patent Number: 5,110,007

[45] Date of Patent: May 5, 1992

[54] DISPENSER

[75] Inventors: Brian R. Law, Leicester; Christopher Harris, Oakham, both of England

[73] Assignee: Imperial Chemical Industries plc, England

[21] Appl. No.: 402,776

[22] Filed: Sep. 5, 1989

[30] Foreign Application Priority Data

Sep. 12, 1988 [GB] United Kingdom ..... 8821287.3

[51] Int. Cl.[5] ..... G07F 11/66

[52] U.S. Cl. ..... 221/25; 221/266; 221/89

[58] Field of Search ..... 221/25, 2, 5, 86, 89, 221/266, 265; 53/255, 390; 206/531, 533, 534, 539

[56] References Cited

U.S. PATENT DOCUMENTS

| | | | |
|---|---|---|---|
| 3,199,489 | 8/1965 | Ruoss | 116/121 |
| 3,394,796 | 7/1968 | Jensen | 206/42 |
| 3,651,927 | 3/1972 | Richardson | 206/534 |
| 3,743,085 | 7/1973 | Richert | 206/42 |
| 3,800,940 | 4/1974 | Thomas | 206/42 |
| 3,904,075 | 8/1975 | Richardson | 221/5 |
| 4,015,717 | 4/1977 | Richardson | 206/534 |
| 4,078,661 | 4/1978 | Thomas | 206/533 |
| 4,165,709 | 8/1979 | Studer | 221/86 |
| 4,298,125 | 11/1981 | Berghahn | 206/531 |
| 4,399,914 | 8/1983 | Damratowski | 206/533 |
| 4,500,012 | 2/1985 | Ackley | 221/266 |
| 4,572,376 | 2/1986 | Wrennall | 206/538 |
| 4,600,122 | 7/1986 | Lundie et al. | 221/266 |
| 4,646,936 | 3/1987 | Frazier et al. | 221/25 |
| 4,667,845 | 5/1987 | Frazier | 221/5 |
| 4,915,256 | 4/1990 | Tump | 221/25 |

FOREIGN PATENT DOCUMENTS

| | | |
|---|---|---|
| 0084119 | 12/1982 | European Pat. Off. . |
| 0146063 | 12/1984 | European Pat. Off. . |
| 198542 | 2/1907 | Fed. Rep. of Germany . |
| 277791 | 7/1911 | Fed. Rep. of Germany . |
| 259858 | 11/1911 | Fed. Rep. of Germany . |
| 298512 | 11/1915 | Fed. Rep. of Germany . |
| 1340808 | 6/1972 | United Kingdom . |
| 1508843 | 3/1975 | United Kingdom . |
| 2052426 | 1/1981 | United Kingdom . |
| 2186269 | 8/1987 | United Kingdom . |

*Primary Examiner*—Robert P. Olszewski
*Assistant Examiner*—Kenneth Noland
*Attorney, Agent, or Firm*—Cushman, Darby & Cushman

[57] ABSTRACT

A blister pack (10) comprises a support sheet (12) having a plurality of pockets (14) each of which retains a tablet (25) so that it rests on an edge (24) with its opposing edge (24) adjacent to a frangible cover sheet (20) which closes the pockets. The pockets comprise a support portion (22) which retains the tablets on their edge, and a guide portion (26) for facilitating loading of the tablets (25) into the support portion (22). The blister pack (10) can be mounted on a plate (50) for relative movement therewith, and a tablet (25) ejected from a pocket (14) by pushing the tablet (25) through the frangible cover sheet (20) and then through a dispensing window (67) in the plate (50).

14 Claims, 4 Drawing Sheets

DISPENSER

The present invention relates to devices for storing and dispensing a substance in unit dosage form, and in particular to novel forms of blister pack and a device incorporating a novel form of blister pack. The present invention also relates to a method of loading a substance in unit dosage form into such devices.

Substances such as pharmaceutically active substances are often packed and distributed in unit dosage form, for example tablet form, in a blister pack. Such packs typically comprise a support member of sheet material having a plurality of recesses or pockets for receiving the tablets and a thin cover member formed from a sheet of frangible material so that when a tablet in a pocket is pushed against the cover member, the latter breaks allowing the tablet to be ejected from the pocket. The tablets themselves are of varying shapes and sizes. However, in known blister packs the tablets usually rest on their surface portion of the largest area. Thus, for example, in the case of disc-shaped tablets they rest on one of the circular faces. In addition to this type of pack, blister packs have been proposed (GB2,052,426; U.S. Pat. No. 3,651,927 and U.S. Pat. No. 4,015,717) in which the tablets reside in their pockets so that they rest on an edge. However, in all the known design of packs, the pockets are generally of complementary shape to, and slightly larger than, the tablet they house, so that the tablet is a loose fit in the pocket.

According to a first aspect of the invention there is provided a blister pack comprising a support member provided with a plurality of pockets each of which contains a composition in unit dosage form having a minor and a major axis of symmetry, and a cover member of sheet material having a frangible portion closing each pocket and rendering each unit dosage form captive within its respective pocket until the respective frangible portion of the cover member is broken by pressure on the pocket and unit dosage form, said pockets being provided with a support portion to retain the unit dosage form in position and a guide portion which guides the dosage form into the support portion of the pocket such that the minor axis of symmetry of the unit dosage form is generally parallel to the plane of the cover member.

The support portion of the pocket retains the unit dosage form within that pocket so that the unit dosage form's minor axis of symmetry is generally parallel to the plane of the cover member, whilst the guide portion guides the unit dosage form into the support portion.

The unit dosage forms suitable for use in the blister pack of the invention include, for example, conventional disc shaped and bevelled tablets, lozenges, capsules, spansules and torpedoes.

When the composition of unit dosage form is orientated so that its minor axis of symmetry is generally parallel to the plane of the cover member, the unit dosage form will tend to rest on a minor surface, for example an edge. For example when the unit dosage form is disc-schaped it will rest on a portion of the circumferential edge, rather than a circular face, and when the dosage form is tablet-shaped it will rest on an edge, rather than a rectangular face.

It will be appreciated that the unit dosage forms are located within the pockets of the blister pack adjacent the cover member such that they are in a position of unstable equilibrium when the pack is placed with the plane of the cover member in a substantially horizontal position. The composition itself may be an essentially pure substance or a mixture of one or more such substances and may preferably be a pharmaceutical composition comprising one or more pharmacologically active substances together with one or more pharmaceutically acceptable diluents or carriers.

The pockets are preferably arranged symmetrically about the centre of the blister pack and generally such that the longitudinal axis of each unit dosage form is radially disposed.

The blister pack is preferably adapted to be held in one hand, for example between the fingers and thumb of that hand.

In practice the support portion is normally deeper than the guide portion, and the base of the guide portion may be inclined relative to the cover member so as to provide a tapered entry to the support portion. Advantageously, the size of each of the pockets is such that entry of a second unit dosage form is discouraged, and to this end it is preferable that, when the pocket includes a guide and a support portion, the size of the pocket is such that when a first unit dosage form is retained in the support portion a second unit dosage form cannot enter and reside in the guide portion with its minor axis of symmetry generally parallel to the plane of the cover member.

The outer wall of the support portion and the outer wall of the guide portion may be inclined relative to one another, with the angle between them preferably acute.

According to a second aspect of the present invention there is provided a method of loading a composition in unit dosage form, having a minor and a major axis of symmetry, into a blister pack to produce a blister pack of the first aspect of the present invention, said method comprising supplying to a face of a support sheet a plurality of unit dosage forms, the support sheet having a plurality of pockets which have mouths in said face and which are each provided with a support portion to retain a unit dosage form in position and a guide portion for guiding the dosage form into the support portion such that the minor axis of symmetry of the unit dosage form is generally parallel to the front face of the support sheet, causing the dosage forms to fall into respective pockets and locate in the support portion thereof such that the minor axis of symmetry of the dosage form is generally parallel to the front face of the support sheet, and providing the said face of the support sheet with a cover member of sheet material so that each pocket is closed by a respective frangible portion of the cover member thereby rendering each dosage form captive within its respective pocket until the respective frangible portion of the cover member is broken by pressure on the pocket and unit dosage form.

The dosage forms may be caused to fall into their respective pockets by moving the dosage forms and the support sheet relative to one another and allowing the dosage forms to fall into the pockets under the influence of gravity. Conveniently, this relative movement may be achieved using a tablet moving means, such as a vibrator or a brush, which may move the tablets directly or indirectly so that the dosage forms move across the front face of the support sheet and fall into the pockets. For example this relative movement may be effected by vibrating the support sheet or by brushing the dosage forms across the front face of the support sheet.

The dosage forms may be supplied to the front face of the support sheet in any orientation, there being no need to correctly orientate the dosage forms prior to loading. In contrast with existing packs, when it is required to load a dosage form so that it rests on a minor surface it is necessary to carefully orientate the dosage form so that its minor surface is above the mouth of the pocket before loading can take place. Furthermore with existing packs, it is necessary to manipulate each dosage form individually during the loading procedure since each dosage form has to be pushed into its pocket.

Thus, the provision of a guide portion allows that the dosage forms to be supplied to the front face of the support sheet so that they are randomly orientated or orientated so that they lie on the front face of the support sheet on a major surface, that is a surface which is other than that surface on which the dosage form is to rest once in the pocket.

According to a further aspect of the present invention there is provided a device for storing and dispensing a substance in unit dosage form, said device comprising a blister pack of the first aspect of the present invention and a plate having a base provided with a dispensing window, the blister pack being mounted on the plate for relative movement and being arranged such that the cover sheet of the blister pack is adjacent the base of the plate and the dispensing window registers, in turn, with the pockets as relative movement is effected so that a unit dosage form can be pushed out of a pocket through the cover sheet and window.

It is preferable that the plate, and particularly the base thereof, is substantially rigid and is conveniently formed from a plastics material. Conveniently, the plate is of generally complementary size to the blister pack. The device is preferably adapted to be held in one hand, for example between finger and thumb, and more preferably the blister pack and the plate are substantially circular in shape.

The blister pack may be mounted on the plate by means of an annular or part-annular arm which is upstanding from the base of the plate and which is arranged to locate in an annular recess, such as a channel, provided on the blister pack. When the pockets are radially disposed, the recess is conveniently provided on the central portion between the pockets.

The device may include a ratchet and pawl mechanism which limits relative movement between the blister pack and the plate to one direction. In this case the unit dosage forms may have various compositions, for example they may contain varying amounts of a pharmaceutically active ingredient, and the unit dosage forms may be arranged in a predetermined order so that they are dispensed in that order. In the case where the device includes an arm upstanding from the base of the plate, the rachet and pawl mechanism may comprise a pawl on the arm which engages with teeth provided in the recess of the blister pack. In a preferred embodiment, the device includes calendar information and the number of unit dosage forms provided on the blister pack is conveniently equal to the number required in a convenient dosage period, such as a week, month or multiple of a week or a month.

The invention will now be further described, by way of example only, with reference to the accompanying drawings, in which.

Figure 1:
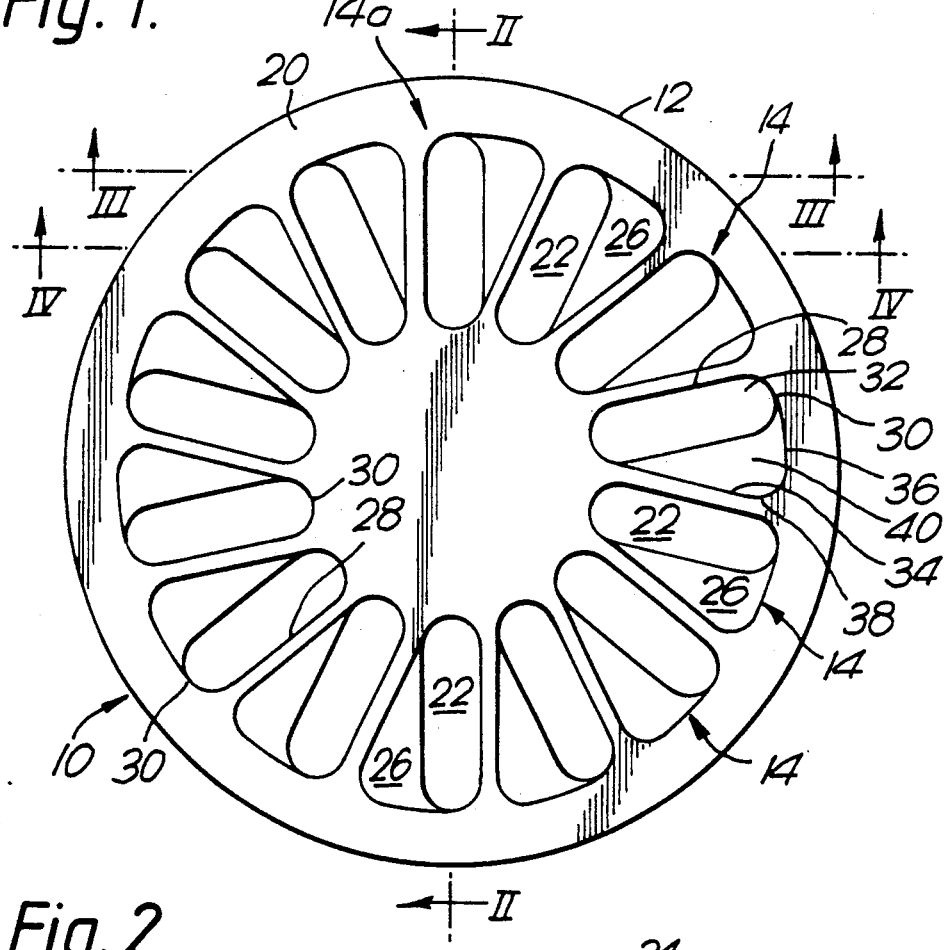
FIG. 1 is a front view of a blister pack with its cover member removed.
Figure 2:
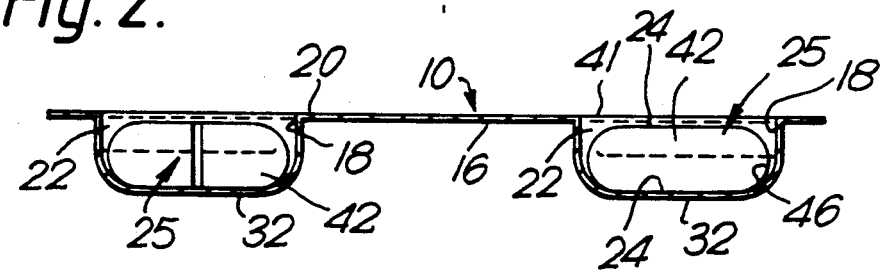
FIG. 2 is a sectional view on the line II—II of FIG. 1.

FIGS. 1 to 4 show a blister pack 10 comprising a circular disc 12 and a plurality of pockets 14 for receiving tablets 25 containing a pharmacologically active substance. The disc 12 is of a size that can conveniently be held between the fingers and thumb of one hand (e.g. about 8 cm diameter) and is formed from a flexible plastics material. The pockets 14 may typically be manufactured by a vacuum drawing technique so that the pockets 14 depend from the rear face 16 of the disc 12.

Figure 3:
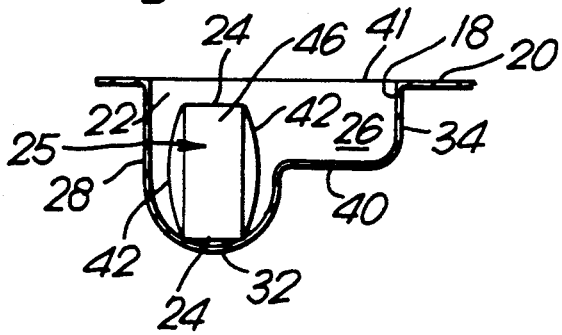
FIG. 3 is an enlarged sectional view of a pocket on line III—III of FIG. 1.
Figure 4:
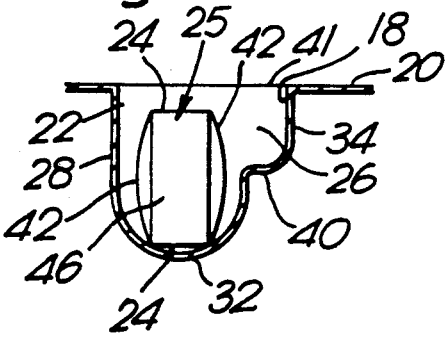
FIG. 4 is an enlarged sectional view of a pocket on line IV—IV of FIG. 1.

Each pocket 14 has a mouth 18 in the front face 20 of the disc 12 and, in the particular embodiment of FIGS. 1 to 4, is generally triangular in plan view. The pockets 14 each comprise a first portion 22 (the support portion) for receiving a tablet 25 and supporting it so that it rests on an edge 24 (see FIGS. 2,3 and 4 ), and a second portion (the guide portion) 26 for facilitating loading of the tablet 25 into the support portion 22. The support portion 22 comprises a straight wall 28, a pair of semi-circular end walls and a semi-circular base 32 which are arranged so that a tablet 25 is a loose fit in the support portion 22 when it lies with one of its edges 24 resting on the base 32 of the support portion 22. The guide portion 26 comprises two straight side walls 34 and 36 connected via a rounded portion 38 so that the side walls 34, 36 are inclined relative to one another with the included angle acute, and a base 40. As shown in FIGS. 3 and 4, the bases 40 and 32 are connected so that the support portion 22 and guide portion 26 together define the pocket 14 with the base 40 forming a ledge or step within the pocket 14 and the outer walls 28 and 34 inclined relative to one another.

The pockets 14 are spaced from the edge of the disc 12 and are equi-angularly spaced in circular fashion with the longitudinal axis of each support portion 22 lying on a radius of the disc. A cover member 41 of thin frangible material, such as foil, is attached to the front face 20 of the disc 12. The tablets 25 are thereby retained within their respective pockets 14 in the filled blister pack 10 by the cover member 41.

Figure 7:
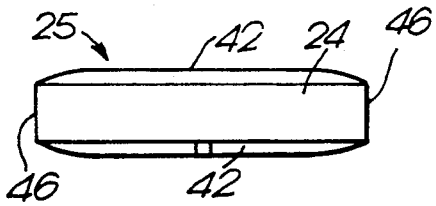
FIG. 7 is a side view of the tablet of FIG. 5.
Figure 6:
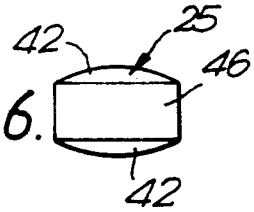
FIG. 6 is an end view of the tablet of FIG. 5.
Figure 5:
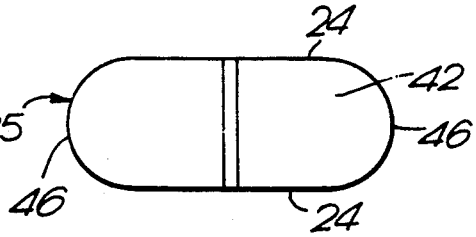
FIG. 5 is an enlarged plan view of a tablet.

FIGS. 5, 6 and 7 show the shape of the tablet 25. The tablet 25 has a pair of faces 42, a pair of edges 24, and a pair of ends 46 with dimensions such that the tablet is lozenge-shaped with overall dimensions of approximately 19 mm by 8.4 mm by 5.6 mm. With a tablet 25 of this shape a pocket 14 having a support portion 22 of approximate depth 8.75 mm, width 6 mm and length 19.5 mm, a guide portion 26 of approximate depth 6.25 mm, and an angle between outer walls 28, 34 of about 26 deg, is suitable.

As illustrated in FIGS. 3 and 4 which are sectional views of the pocket 14*a*, the base 40 of the guide portion 26 is substantially parallel to the mouth 18 of the pocket 14 and front face 20 of the disc 12.

Figure 13:
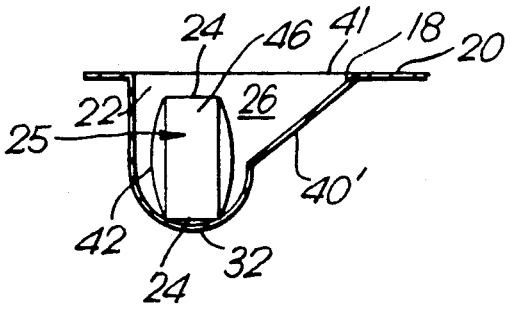
FIG. 13 is an enlarged sectional view of a pocket on line III—III of FIG. 1, but illustrating a modified pocket shape.
Figure 14:
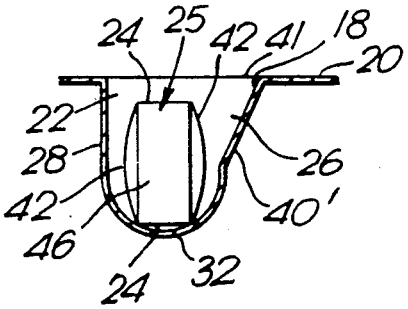
FIG. 14 is an enlarged sectional view of a pocket on line IV—IV of FIG. 1, but also illustrating the modified pocket shape shown in FIG. 13.

In an alternative embodiment, the shape of the pockets 14 are as described above, with the exception that the base 40' is inclined relative to the mouth 18/front face 20 of the disc 12 so that the base 40' provides a tapered entry to the support portion 22. As shown in FIGS. 13 and 14, the inclined base 40' extends from the support portion to the front face 20 of the disc 12.

Figure 15:
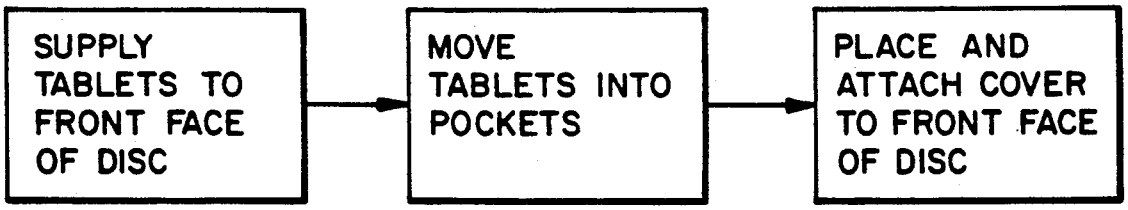
FIG. 15 schematically depicts the method of filling the disk of the invention.

To fill the blister pack (FIG. 15), tablets 25 are supplied to the front face 20 of the disc 12 where they tend to lie with a face 42 in contact with the front face 20. The tablets 25 are then moved into the pockets 14 by use of a hair brush or by vibrating the disc 12. As a tablet 25 falls into a pocket 14, the guide portion 22 guides the tablet 25 into the support portion 26. In this process, each of the tablets 25 tips over onto one of its edges 24 so that they rest on their edges 24 in the support portion. When each pocket 14 contains a tablet 25, a cover member of frangible material, such as foil, is placed over the front face 20 of the disc 12 and attached to the disc 12 to render the tablets 25 captive in their respective pockets 14. The dimensions of a pocket 14 are such that when a tablet 25 is located in the support portion 22 on its edge 24, a second tablet 25 cannot enter the pocket 14, thus preventing the loading of more than one tablet into a pocket 14.

To remove a tablet 25 from a pocket 14 (and hence from the blister pack 10) the base 30 of the support portion 22 of the pocket 14 is pushed by the user towards the mouth 18 and foil. The foil breaks as a result of the edge 24 of the tablet acting on it and the tablet 25 is ejected. For convenience the number of pockets 14 on the disc 12 is equal to the number of tablets 25 required by a patient for a given period of time. For example, in the case illustrated, fourteen pockets 14 are provided to give 2 weeks supply of "once a day" tablets. A sheet of paper or card carrying calendar information can be secured to the cover member, or calendar information can be printed directly onto the cover member.

Since the tablets are stored in the blister pack in an edge-wise fashion, more tablets can be packed into a given area of pack than is possible by conventional face-packing. Edge-packing also facilitates removal of the tablets from the pack, and the smaller size blister pack possible by utilising edge-packing enables the pack to be held in one hand and permits one-handed operation. Also the pressure on the tablet during ejection is minimised since the portion of the tablet presented to the cover member is of lower surface area than would be the case if the tablets were face-packed. Furthermore, the shape of the pockets facilitates filling of the blister pack since the tablets may be loaded into their respective pockets without the need for orientating each tablet individually prior to loading, or for pushing the tablets into their pockets. In contrast, in order to load tablets into known packs so that they rest on an edge it is necessary to carefully position each tablet above its pocket so that it is in the correct orientation and then push each tablet into its pocket.

Figure 8:
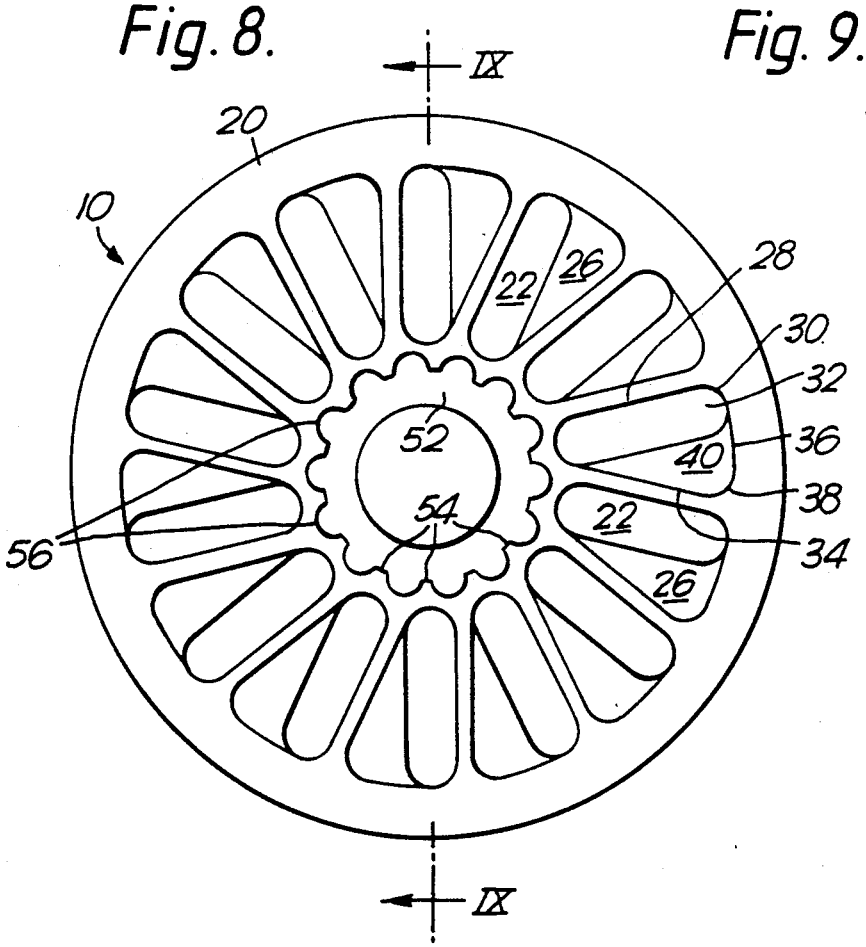
FIG. 8 is a front view of a modified blister pack with its cover member removed.
Figure 9:
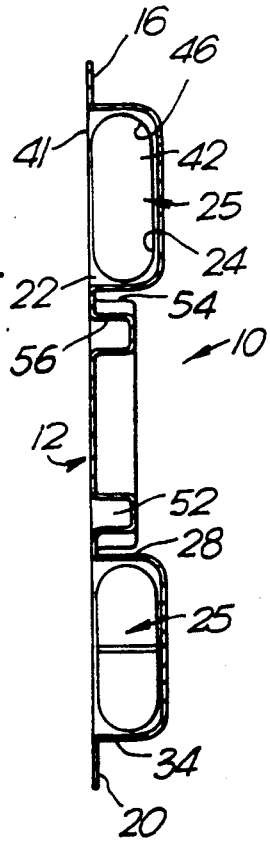
FIG. 9 is a sectional view on the line IX—IX of FIG. 8.

In a further embodiment of the invention a modified form of blister pack 10 is combined with a dispensing device 50. The modified blister pack is illustrated in FIGS. 8 and 9 to have a circular channel 52 in the central portion of the disc 12 between the pockets 14. A plurality of equally spaced teeth 54 are provided on the outer edge 56 of the channel 52 such that the teeth 54 extend part way across the width of the channel 52. Arcurate recesses 58 are provided between adjacent teeth 54 and the number of teeth 54 is equal to the number of pockets 14.

Figure 10:
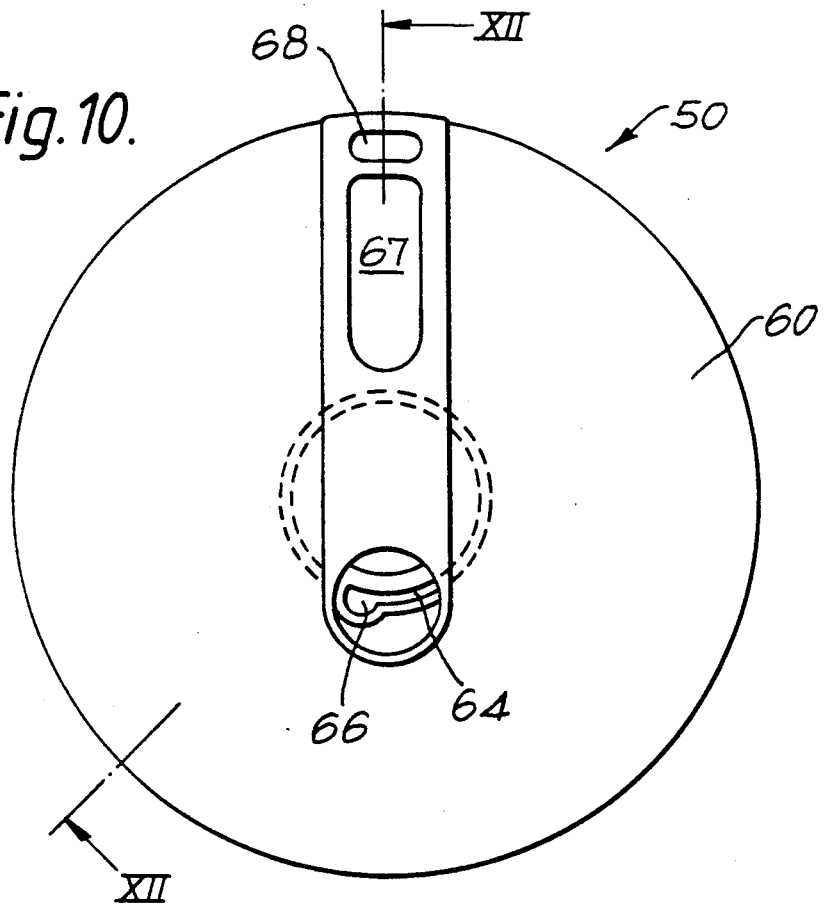
FIG. 10 is a plan view of a dispensing device.
Figure 11:
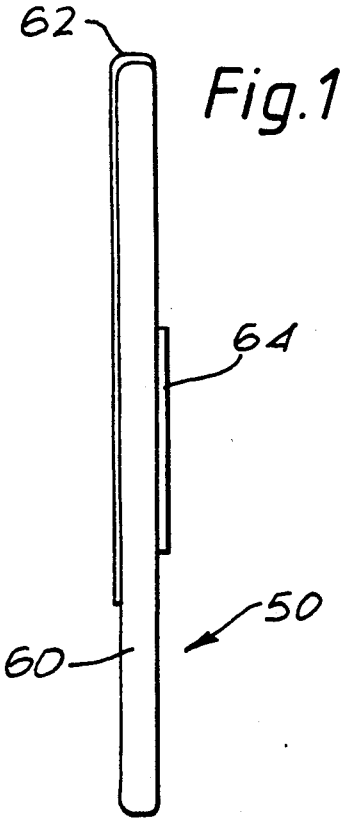
FIG. 11 is a side view of the device of FIG. 10.
Figure 12:
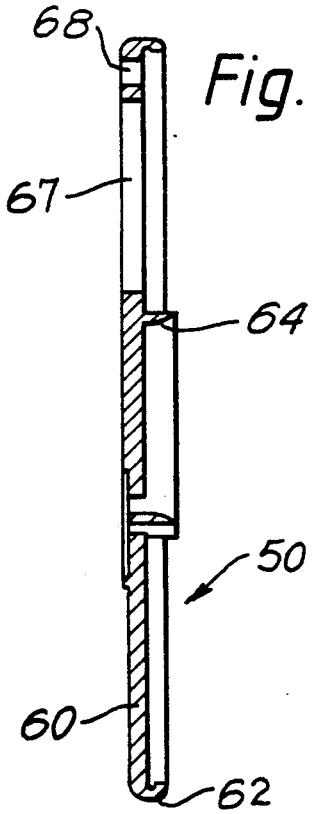
FIG. 12 is a sectional view on line XII—XII of FIG. 10.

FIGS. 10, 11 and 12 show the dispensing device 50 which comprises a rigid circular plate 60 generally provided with a raised edge or rim 62 at its periphery. A resilient, part annular arm 64, having a semi-circular protrusion 66 at one end, extends outwardly from the central portion of the plate 50. The arm 64 is secured to the plate 60 along part of its length, but the plate 60 is cut away beneath the arm 64 near to the end carrying the protrusion 66 so that the arm is free to move towards and away from the centre of the plate 60 at that end, The modified blister pack 10 fits between the rim 62 with the arm 64 located in the channel 52 and the protrusion 66 located in a recess 58 between adjacent teeth 54. The resilient arm 64 and the spaced teeth 54 of the channel of the modified blister pack 10 form the pawl and ratchet respectively of a ratchet and pawl mechanism. The arrangement is such that when the protrusion 66 locates in a recess 58, a dispensing aperture 67 in the plate 60 registers with a pocket 14. As shown in FIG. 10 a further aperture is provided in the plate 60. This aperture 68 is used as a display window for viewing calendar information printed on the cover member 41, or on a sheet of paper or card (not shown) which is secured to the front face 20 of the blister pack 10.

In use, the blister pack 10 and dispensing device 50 are pushed together so that the arm 64 breaks the portion of the cover member 41 sealing the channel 52 and the arm locates in the channel 52 with the protrusion engaged in a recess 58. The calendar data is viewed through the display window 68 and a tablet 25 ejected by pressing the base 30 of the support portion 22 of the pocket in registry with the dispensing aperture 67 towards the plate 60. This action results in the tablet 25 breaking the cover member 41 and being pushed edge-wise out of the pocket 14 and through the dispensing aperture 67. Rotation of the blister pack 10 then brings the next days tablet into registry with the dispensing aperture 67 and the next day into the viewing window 68. Rotation is uni-directional due to the presence of the ratchet/pawl mechanism so that tablets are presented at the dispensing aperture 68 in the correct daily sequence.

The edge-wise packing and rigidity of the device 50 facilitates one-handed operation and permits tablets 25 to be ejected using one hand and collected in the other.

Although in the embodiments described above the base of the guide portion is either substantially parallel to the cover member/front face of the disc or is inclined such that it is joined to the front face of the disc, the angle of inclination of the base may be varied so that instead of being joined directly to the front face of the disc the base is joined to a side wall which depends from the front face of the disc. Also, the position of the ratchet and pawl mechanism may be varied, for example the ratchet can be provided on the circumferential edge of the disc and the pawl provided on the plate so as to co-operate with the ratchet.

Although the invention is described in the preferred embodiments above includes tablets comprising a pharmacologically active substance, the invention is not limited to such, and is suitable for use with any material to be stored in unit dosage form in a dry, airtight situation. For example, the invention can be used to store/-dispense other chemically-based substances, such as pesticides and soil additives.

We claim:

1. A blister pack comprising a support member provided with a plurality of pockets each of which contains a composition in unit dosage form having a minor and a major axis symmetry, and a cover member of sheet material having a frangible portion closing each pocket and rendering each unit dosage form captive within its respective pocket until the respective frangible portion of the cover member is broken by pressure on the pocket and unit dosage for, said pockets being provided with a support portion to retain the unit dosage form in position and a guide portion which guides the dosage form into the support portion of the pocket whereby the guide portion provides a means which guides the unit dosage form into the support portion of the pocket and orients the unit dosage form into the support portion such that the minor axis of symmetry of the unit dosage form is generally parallel to the plane of the cover member.

2. A blister pack as claimed in claim 1 wherein the outer wall of the support portion and the outer wall of the guide portion are inclined relative to one another.

3. A blister pack as claimed in claim 1 wherein the pockets are arranged symmetrically about the centre of the blister pack and gnerally such that the longitudinal axis of each unit dosage form is radially disposed.

4. A blister pack as claimed in claim 1 wherein the base of the guide portion is inclined relative to the cover member so as to provide a tapered entry to the support portion.

5. A blister pack as claimed in claim 1 wherein the base of the guide portion is substantially parallel to the cover member.

6. A blister pack as claimed in claim 1 wherein the composition in unit dosage form is a pharmaceutical composition comprising one or more pharmacologically active substances.

7. A device for storing and dispensing a substance in unit dosage form, said device comprising a blister pack as claimed in claim 1 and a plate having a base provided with a dispensing window, the blister pack being mounted on the plate for relative movement and being arranged such that the cover sheet of the blister pack is adjacent the base of the plate and the dispensing window registers, in turn, with the pockets as relative movement is effected so that a unit dosage form can be pushed out of a pocket through the cover sheet and window.

8. A device as claimed in claim 7 which further includes a ratchet and pawl mechanism which limits movement between the blister pack and the plate to one direction.

9. A device as claimed in any one of claim 7 in which the device is adapted to be held in one hand.

10. A device for storing and dispensing a substance in unit dosage form comprising:

a blister pack including a support member provided with a plurality of pockets, each of which contains a composition in unit dosage form having a minor and a major axis of symmetry, and a cover member of sheet material having a frangible portion closing each pocket and rendering each unit dosage form captive within a respective pocket until the respective frangible portion of the cover member is broken by pressure on the pocket and unit dosage form, said pockets being provided with a support portion to retain the unit dosage form in position and a guide portion which guides the unit dosage form into the support portion of the pocket such that the minor axis of symmetry of the unit dosage form is generally parallel to the plane of the cover member;

in combination with:

a plate having a base provided a dispensing window, the blister pack being mounted to said plate for relative movement and being arranged such that the cover sheet of the blister pack is adjacent to the base of the plate and the dispensing window registers, in turn, with the pockets as relative movement is effected so that a unit dosage form can be pushed out of a pocket through the cover sheet and window, and a ratchet pawl mechanism for limiting movement between the blister pack and the plate to one direction, the pawl being provided on a part-angular arm which is upstanding from the base of the plate, and the ratchet comprises teeth provided in a recess in the blister pack.

11. A method of loading a composition in unit dosage form, having a minor and a major axis of symmetry, into a blister pack said method comprising supplying to a face of a support sheet a plurality of unit dosage forms, the support sheet having a plurality of pockets which have mouths in said face and which are each provided with a support portion to retain a unit dosage form in position and a guide portion for guiding the dosage form into the support portion such that the minor axis of symmetry of the unit dosage form is generally parallel to the front face of the support sheet, causing the dosage forms to fall into respective pockets and locate in the support portion thereof such that the minor axis of symmetry of the dosage form is generally parallel to the front face of the support sheet, and providing the said face of the support sheet with a cover member of sheet material so that each pocket is covered by a respective frangible portion of the cover member thereby rendering each dosage form captive within its respective pocket until the respective frangible portion of the cover member is broken by pressure on the pocket and unit dosage form.

12. A method as claimed in claim 11 wherein the support sheet is vibrated to effect relative movement between the unit dosage forms and the support sheet to facilitate loading of the dosage forms into their pockets.

13. A method as claimed in claim 11 wherein the unit dosage forms are brushed across the front face of the support sheet to facilitate loading of the dosage forms in the pockets.

14. A method as claimed in claim 11 wherein the unit dosage forms are provided on the front face of the support sheet so that they are randomly orientated or so that they rest on that face on a major surface.

* * * * *